United States Patent [19]

Haapala

[11] 4,129,969

[45] Dec. 19, 1978

[54] STRUCTURAL SPACE ELEMENT

[76] Inventor: Jalo Haapala, Temppelikatu 8 A 23, Helsinki, Finland

[21] Appl. No.: 696,333

[22] Filed: Jun. 15, 1976

[30] Foreign Application Priority Data

Jun. 27, 1975 [FI] Finland ..... 751913
Nov. 17, 1975 [FI] Finland ..... 753231

[51] Int. Cl.[2] ..... E04B 5/48; E04C 1/30

[52] U.S. Cl. ..... 52/79.9; 52/251; 52/574

[58] Field of Search ..... 52/79, 236, 251, 574, 52/79.1, 77.9

[56] References Cited

U.S. PATENT DOCUMENTS

| | | | |
|---|---|---|---|
| 3,350,085 | 10/1967 | Over | 52/574 |
| 3,468,081 | 9/1969 | Saarinen | 52/79 |
| 3,514,910 | 6/1970 | Comm | 52/228 X |
| 3,550,334 | 12/1970 | Van Der Lely | 52/228 X |
| 3,564,795 | 2/1971 | Henton | 52/236 X |
| 3,609,929 | 10/1971 | Brown et al. | 52/236 X |
| 3,962,835 | 6/1976 | Little | 52/79 |
| 3,982,366 | 9/1976 | Haapala | 52/236 X |

FOREIGN PATENT DOCUMENTS

| | | | |
|---|---|---|---|
| 684712 | 1/1967 | Belgium. | |
| 1684655 | 4/1971 | Fed. Rep. of Germany. | |
| 2200052 | 7/1973 | Fed. Rep. of Germany | 52/79 |
| 1216194 | 11/1959 | France. | |
| 1264580 | 5/1961 | France. | |
| 1414158 | 9/1965 | France. | |
| 2040513 | 1/1971 | France. | |
| 2132987 | 11/1972 | France. | |
| 2209025 | 6/1974 | France. | |
| 471301 | 5/1969 | Switzerland. | |

*Primary Examiner*—Alfred C. Perham
*Attorney, Agent, or Firm*—Frank J. Jordan

[57] ABSTRACT

Disclosed is a structural space element which consists of a tube having joining collars on its outer surface which protrude with equal depth throughout their perimeter. The joining collars are thicker along the side walls of the element. The thicker parts serve as vertical pillars. The collars are arranged in such a manner that the element is likable to corresponding other structural elements, situated at an angle of 180° in relation to this element. Linked together the elements form a beam-pillar-ring system in which the elements are disposed opposite and imbricately to each other.

10 Claims, 12 Drawing Figures

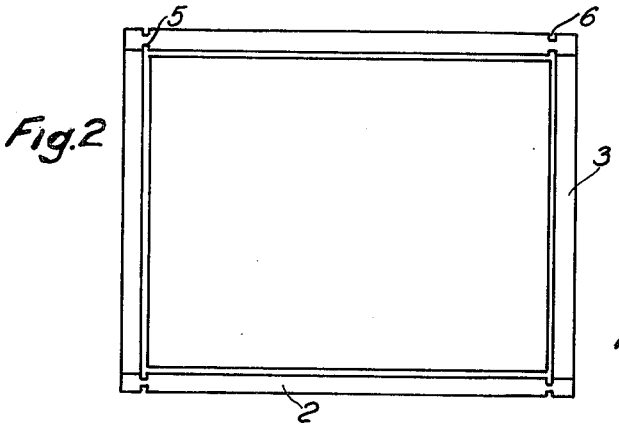
Fig.2
5
6
3
2
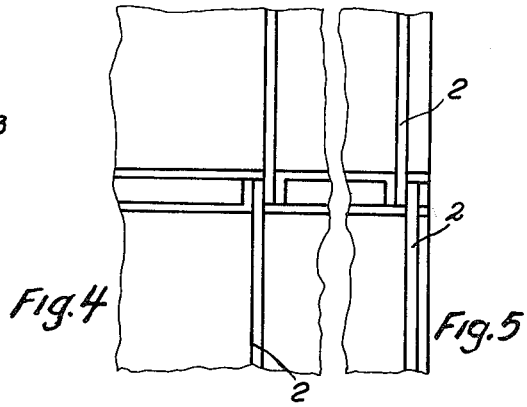
Fig.4
Fig.5
2
2
2
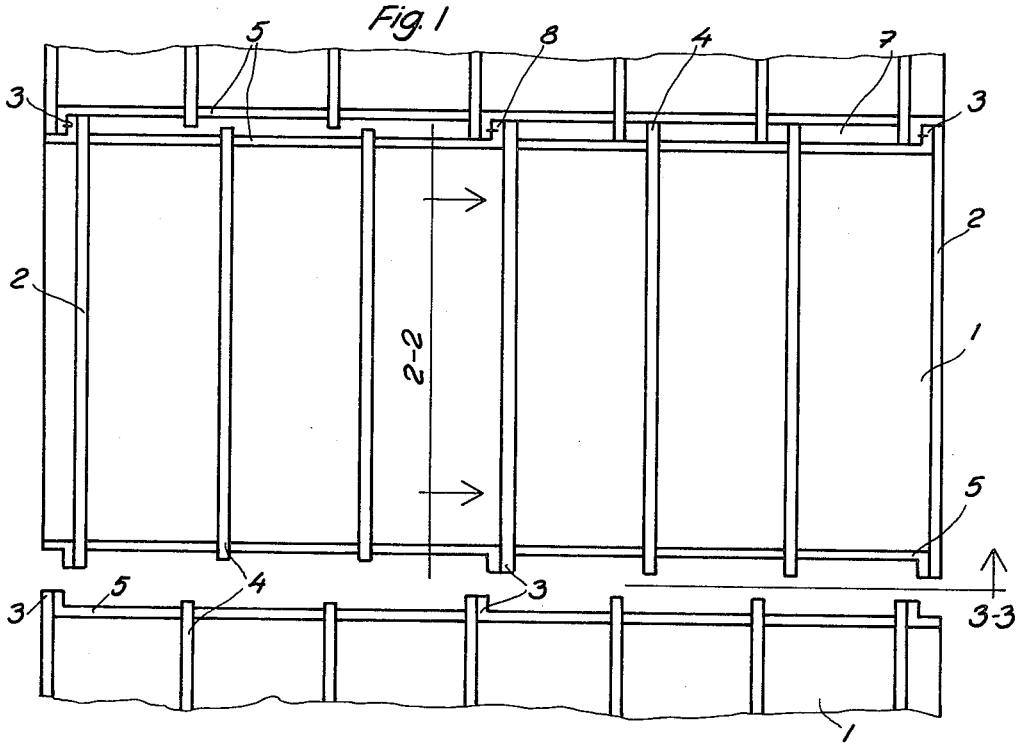
Fig. 1
5
8
4
7
3
3
2
2
1
2-2
5
3
5
4
3
3-3
1
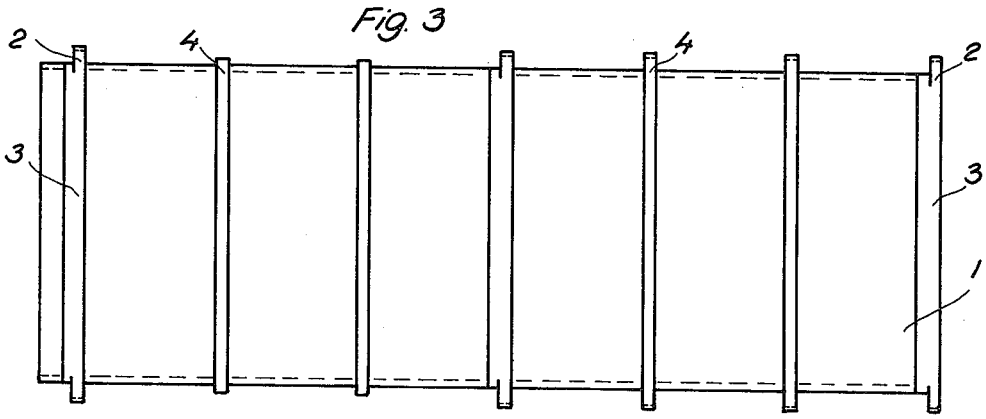
Fig. 3
2
4
4
2
3
3
1

STRUCTURAL SPACE ELEMENT

BACKGROUND OF THE INVENTION

The present invention relates to a structural space element, e.g., a steel concrete space element, which consists of a tube having on its outer surface joining collars which protrude with equal depth through their perimeter and being arranged transverse to the element and extending around the element at fixed intervals.

Such a structural space element is known from, for example, German Published Application No. DOS 2 200 052. Furthermore, U.S. patent application Ser. No. 557,553 now U.S. Pat. No. 3,982,366 (J. Haapala) discloses a structural element in which every second transverse joining collar has a wider perimeter than the adjacent ones. The joining collars can be connected to smaller-perimeter joining collars of other, corresponding structural elements, and vice versa, so that appropriate spaces for the necessary installations are obtained between the elements. In addition, the joining collars of an element, connected to the joining collars of other elements, form together with them in the total structure a beam-pillar-ring system in which the elements are disposed opposite to each other.

SUMMARY OF THE INVENTION

The object of the present invention is to provide a structural element which, when connected to other corresponding structural elements, forms together with them in the total structure a beam-pillar-ring sytem as presented above in which the elements are disposed opposite and/or imbricately to each other. The characteristics of the invention are given in the enclosed claims. The elements are advantageously manufactured from concrete but they can also be made from any suitable material.

When compared with the known structural elements, the following advantages are gained:

All the joining collars are of similar structure so that all elements of the same predetermined length are also similar. Fitting the elements in relation to each other at the construction stage is thereby considerably facilitated. The manufacture of such similar elements is naturally also simpler and less expensive. The manufacture is simpler also because the cross section of the joining collars, with the exception of the pillar parts of the collars, can be the same as the cross section of the reinforcement collars which are possibly located between the joining collars in order to reinforce the element; the reinforcement collars can also have the same perimeter as the joining collars. The outer corners of the joining collars are solid, and therefore steel concrete reinforcements inside the element are not necessary. The vertical pillar parts of the joining collars position themselves next to each other in the space between the elements and thereby form a pair of pillars, in which case they can be connected to each other constructively by, for example, by tenon or bolted jointing in such a manner that they together form one pillar, in which case smaller collar dimensions can be used. Alternatively the pillars can be shaped in such a manner that they imbricate, thereby forming a pillar pair of the type described above. The pillars are connected to each other either endwise or imbricately. The element becomes lighter since its own weight is reduced owing to the smaller cross section of the beams and/or the pillars. The weight of an element is supported by only one part of the combined pillar. Furthermore, the joining collars are subjected to considerably smaller internal and external forces, such as those caused by the wind and those affecting from above. The horizontal beam parts of the joining collars, with a smaller cross section than the pillars, can imbricate and thereby form a full-length pillar at the outer corner of the elements.

This structural element, which has preferably a rectangular cross section, can be manufactured industrially, making use of automation, from steel concrete in one casting into a complete structural entity with finished surfaces, in which case it is in regard to its technical solution a thin-walled tubular structure, a blank having on its outer surface joining collars which are transverse to the element, extend around it, and are arranged at fixed intervals.

The joining collars, which serve as pillars on the side walls and as beams on the floor and roof sides, form not only a beam-pillar-ring system, but their parts joining the element roof form together with the element wall a ceiling frame and their parts joining the element floor form together with the element wall a floor frame, thereby stiffening the structural element in the transverse direction. When elements are connected, piled or stacked one on top of and/or next to the other, the constructional parts imbricate thereby forming the minimum partition wall and/or floor thickness.

The cross sections of the element, as well as those of the beams and the pillars, can be selected according to the intended use. The collars of the element can be profiled in such a manner that they are suitable for attachment-supporting frames for doors, windows, thermal insulations, or the like, in which case separate supporting structures can be eliminated. The steel concrete reinforcements fitted at the outer corners of the element and forming together with the collars a fitting unit for the structural elements to be attached to the element, can be situated on the roof plane or the side wall planes, depending on the intended use. Furthermore, in the side walls the reinforcements can be extended from the top as far as the door height, for example, in which case the reinforcement collars have been profiled in such a manner that door, window, flue, and other component cassettes can be lowered to bear on them. The roof of the element can be eliminated, in which case roof units can be fitted between the reinforcement collars and be supported by them. These roof units can be of different types, depending on the intended use. Besides the roof, one or both of the side walls, or part of the, can be eliminated. The element can thus comprise, for example, only the floor and the joining and reinforcement collars or only a wall part comprising the joining collars plus steel concrete reinforcements, extending from above as far as the door height, for example.

The reinforcement collars can also be replaced by ridges between the joining collars in the element walls. The walls of the element can also be profiled in the desired manner.

If it is desired to vary massive constructions by, for example, transferring some elements in their longitudinal direction in relation to the structural elements linked to them, the dimension of the supporting parts corresponding to the pillars of the transferred elements is extended in the direction of the transfer.

The invention also relates to a structural element cast in one piece from steel concrete, comprising a tubular structure with a polygonal cross section and its collar having been steel-reinforced, in which case the object is to make the corners of the collars of such elements structurally very stiff, which gives the elements great resistance not only to vertical but also to horizontal forces. Owing to the structural stiffness of the corners of the collars, when elements are connected to each other, for example, when piling or stacking them to form large entities such as high-rise buildings, a separate structural frame or bearing structure is not necessary.

The corner stiffness of the collars set forth in the following description. The structural element, stiffened with steel reinforcements, is thus made in one casting that is, the tubular structure with its collars and all its constructional parts. The collars are in such a case preferably bound to each other with steel concrete reinforcements in the longitudinal direction of the element, arranged at its outer corners.

The reinforcement of the walls of the structural elements with steel-reinforced ribs transverse to the element is known per se from, for example, German Published Application No. 2 200 052 mentioned above. The ribs have not, however, been reinforced in such a manner that they alone would meet the static requirements set for a total structure. When elements are connected to each other, concrete is cast between the elements, both on the vertical and the horizontal planes, to produce a separate structural frame in order to meet the static requirements set for the total structure. When the corners of the collars are made stiff according to the present invention, concrete need not be cast between the elements in order to produce a structural frame even when building multi-storied buildings, because the elements are self-bearing and can therefore be simply stacked or piled one on top of or next to the other. The elements then imbricate securely, i.e., the side wall constructions of adjoining elements and the roof and floor constructions of elements placed one on top of the other are locked tightly to each other by gravity, thereby providing an uninterrupted multi-unit total structure.

According to the invention, the reinforcement steel close to the outer perimeter of the collars can form a continuous ring approximately parallel to the perimeter of the collars, but this is not necessary in all cases, as long as the reinforcement still is continuous at the corners. The corners of the collars can be made very stiff by anchoring according to the invention the inside reinforcement steel of the collars at the corners of the collars. In such a case the inside reinforcement steel can be welded to the steel situated close to the outer perimeter of the collars. The anchoring can, however, be performed by any suitable method. In order to achieve a suitable anchoring length, the inside reinforcement steel can also be extended to the reinforcement steel situated close to the outer perimeter of the collars and be made parallel to the latter collars by bending. In addition, the inside reinforcement steel can be welded to each other at their crossing points, if necessary. One alternative method is to form anchoring loops in the inside reinforcement steel at the corners of the collars or to anchor this reinforcement steel by means of separate loops at the corners of the collars. It is very advantageous to manufacture both the inside and the outside reinforcement steel from the same steel, which forms anchoring loops at the corners of the collars.

BRIEF DESCRIPTION OF THE DRAWINGS

The other factors essential to the invention are disclosed below; some embodiments of the structural element according to the invention are described with reference to the enclosed drawing without, however, limiting the invention to them.

In the drawings,

FIG. 1 depicts a top view of the structural element and the linking of the element to two adjoining similar elements.

FIG. 2 is a cross section of the element along line 2—2 in FIG. 1.

In FIG. 3 the element according to FIG. 1 is seen from the side.

FIGS. 4 and 5 depict top views of two different cases, in which, on top of, beside or crosswise with elements according to FIG. 1, there have been fitted structural elements which are situated at an angle of 180° C in relation to the elements according to FIG. 1.

DESCRIPTION OF THE PREFERRED EMBODIMENTS

Figure 2A:
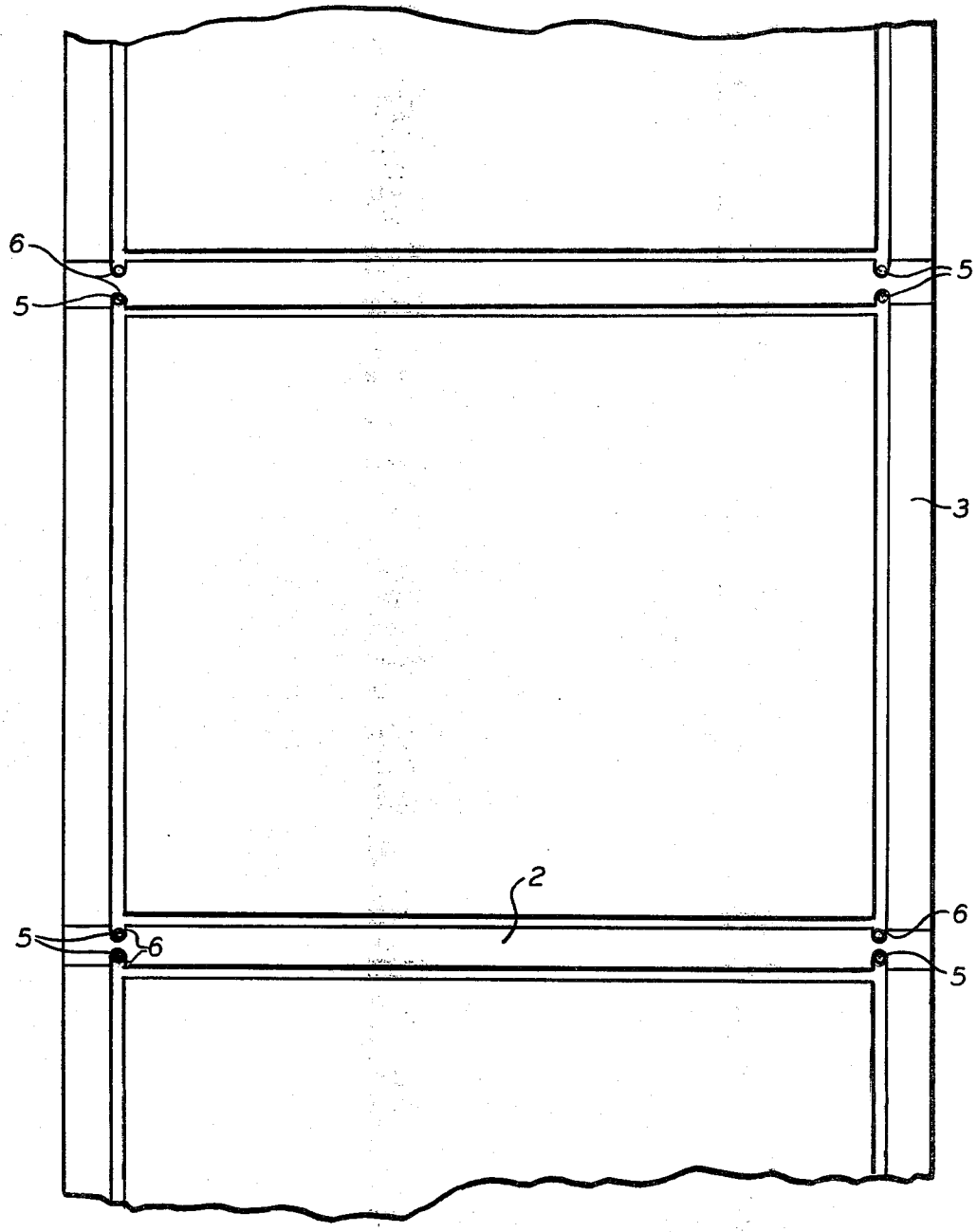
FIG. 2A is a view similar to FIG. 2, but showing a plurality of mated elements.

The figures in the drawing illustrate a structural element which has a cross section in the shape of a rectangular parallelogram and which has been cast in one piece. The walls 1 of the element are of thin concrete. The floor is steel reinforced. Every third of the collars is a joining collar (FIGS. 1 to 5) consisting of horizontal beams 2 and of thicker vertical pillars 3 with a thickness double the thickness of the beams. Between the joining collars there are reinforcement collars 4 which reinforce the element and can have the same dimensions as the joining collars but can also be of different size.

At the outer corners of the elements there have been arranged steel concrete reinforcements 5 which protrude from the planes of the element and by means of which the collars 4 of the element are bound to each other. The reinforcements 5 together with the collars 4 form the unit for fitting the structural elements to be linked to this element. At the outer corners of the collars of the element there have been made grooves 6 into which the steel concrete reinforcements 5 of the structural elements to be linked to this element fit to form an uninterrupted structural entity.

As seen in FIGS. 1, 4, and 5, the element is linked to corresponding other elements on the side or on the top, the other elements being situated at an angle of 180° in relation to it. Thereby the element together with the other ones form in the total structure a beam-pillar-ring system in which the elements are disposed opposite and/or inbricately to each other. The pillar parts 3 of the joining collars are linked together either perpendicularly endwise or imbricately. The pillar parts 3 position themselves next to each other in the space 7 between the elements and thereby form a pillar pair. The joining collars have been attached to each other by means of joints such as bolted joints or the like. FIG. 1 shows the spaces 7 between the elements; these spaces can very well be used for installations, insulations, etc.

Figure 6:
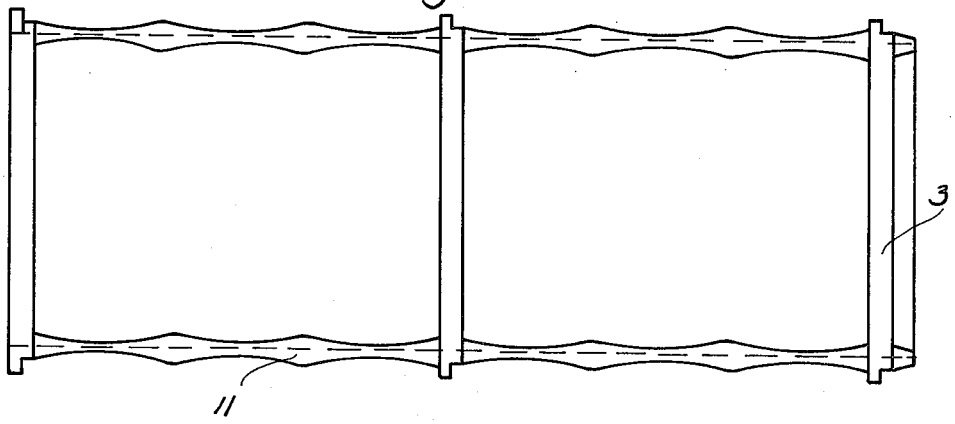
FIG. 6 shows a side view of an element with ridges in its walls.
Figure 7:
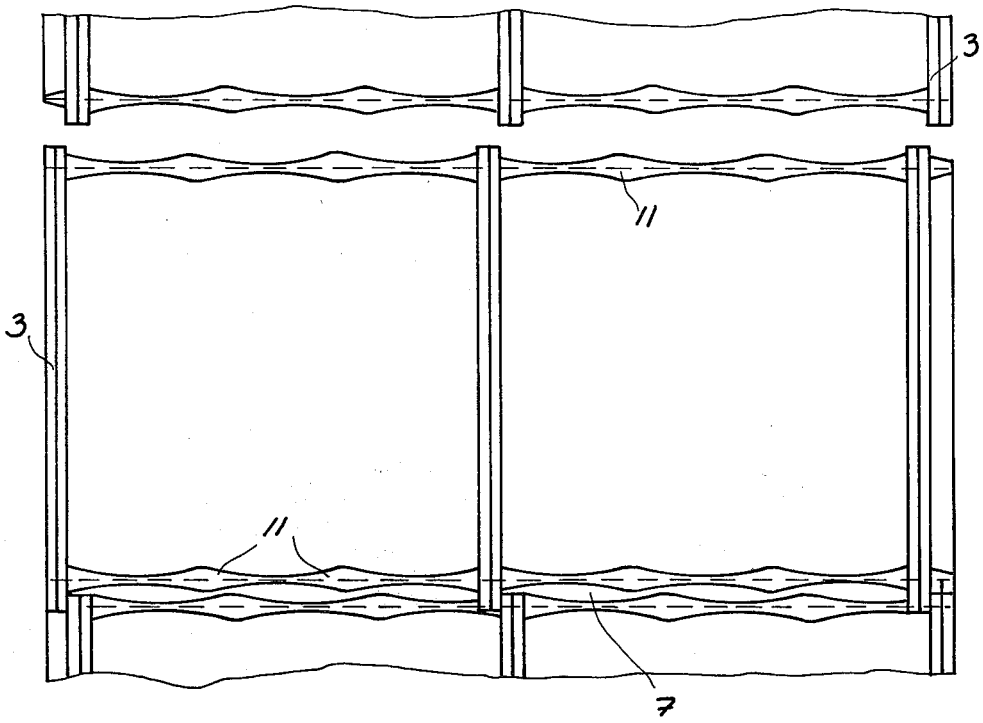
FIG. 7 depicts the linking of such elements to each other.

FIGS. 6 and 7 show an embodiment in which the reinforcement collars have been replaced by ridges 11 between the joining collars. These ridges overlap, as seen in FIG. 7, but the necessary intermediate space 7 is still left between them.

Figure 8:
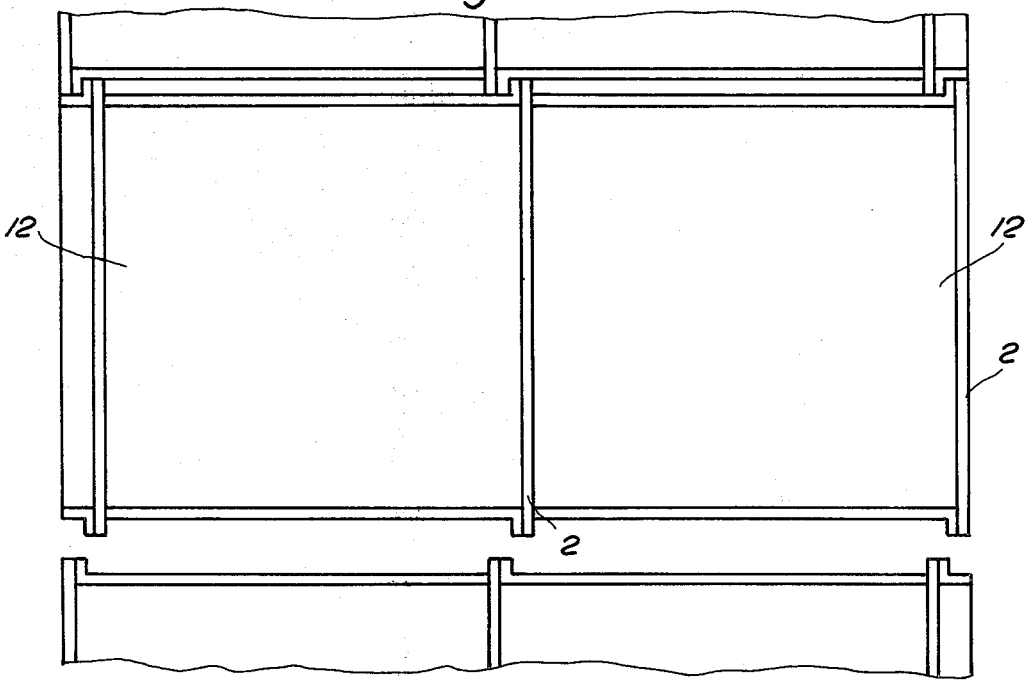
FIG. 8 depicts a partial top view of elements without a roof and Fig. 9 a side view of an element in which the wall extends from the top only as far as the door height.
Figure 9:
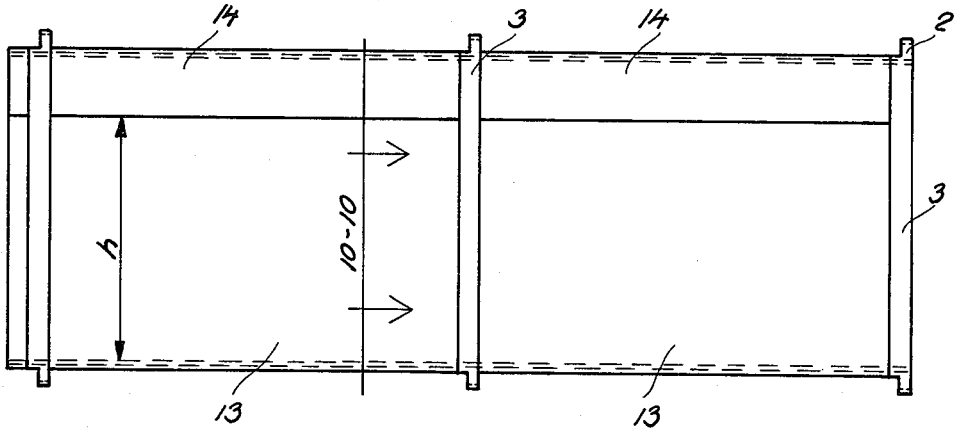
Figure 10:
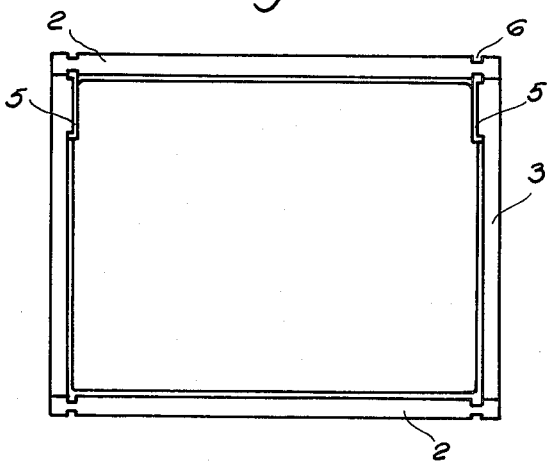
FIG. 10 depicts a cross section of the element along line 10—10 in FIG. 11.

The embodiment according to FIG. 8 has no roof, and roof units can be placed between the beams 2 of the joining collars and be supported by them in order to cover the openings 12. According to FIG. 9 there are openings 12 in the walls, and the reinforcements 5 of the upper corner of the element extend into the space inside the element as shown in FIG. 10, in which case the wall part 14 extends from the top only as far as the door height h. The joining collars 2, 3 of the element and, when necessary, the reinforcement collars can be profiled in such a way that they serve as attachment-supporting frames for doors, windows, thermal insulations, and the like.

Figure 11:
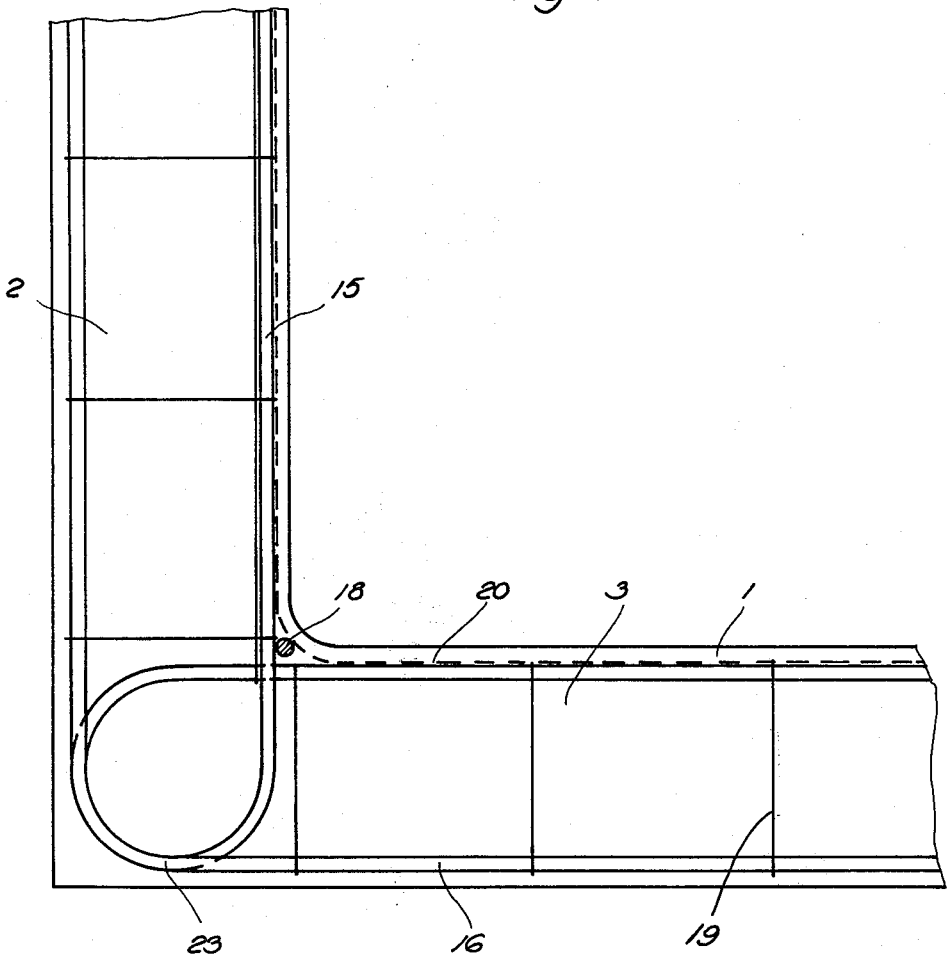
FIG. 11 depicts, on a larger scale, a partial cross section of a steel concrete element cast in one piece, in which the inside and the outside reinforcement steel are of the same steel, which forms anchoring loops at the corners of the collars.

The walls 1 of the tubular element with a cross section the shape of a rectangular parallellogram according to FIG. 11 have been made from relatively thin concrete. Collars 2, 3 protrude from the wall and form a beam-pillar ring. The inside reinforcement steel 15 of the collars which is of the same steel as the outside reinforcement steel 16 situated close to the outer perimeter of the collars from anchoring loops 23 at the corners of the collars. The reinforcement steels 16 form a continuous ring in this embodiment. Furthermore, the element has been reinforced with steel 18 in its longitudinal direction, and the hook ereinforcment steel 19, transverse to the collars, connect the reinforcement steel 15 and 16 to each other. In the wall 1 of the element there can be at certain points or extending around the element a net which reinforces it, indicated by 20 in the figure.

What is claimed is:

1. A building structure comprising a plurality of mated spaced elements, each of said space elements comprising a tube element having two generally vertical walls along with a generally horizontal floor and ceiling, each of said tube elements having a longitudinal axis, each of said tube elements having collar means transversely circumscribing the outside of the respective tube element at fixed intervals to define beam-pillar-rings, said collar means having vertical pillar portions disposed along said two vertical walls and horizontal beam portions disposed along said general horizontal floor and ceiling, said pillar portions having a cross-sectional area greater than said beam portions, said tube element being mated such that the collar means of one tube element mates with the collar means of the other tube elements, said tube elements being mated side-by-side and one upon and beneath the other by inverting one tube element end-to-end relative to an adjacent tube element such that the collar means on one tube element overlaps with the collar means on the other mating tube element, whereby said overlapping collar means form double overlapping collars, steel reinforcement means anchored in the corners of said collar means, said steel reinforcement means forming at the corners of said collar means closed loops to make said corners structurally stiff, and elongated steel concrete means located at the outer corners of said tube elements and interconnecting the collars of mated tube elements.

2. A structural space element adapted to be mated with similar space elements to form a building structure comprising a tube element having two generally vertical walls along with a generally horzontal floor and ceiling, said tube element having a longitudinal axis, said tube element having collar means transversely circumscribing the outside of the tube element at fixed intervals to define beam-pillar-rings, said collar means having vertical pillar portions disposed along said two vertical walls and horizontal beam portions disposed along said general horizontal floor and ceiling, said pillar portions having a cross-sectional area greater than said beam portions, said tube element being mated with another like tube element such that the collar means on one end tube element mates with the collar means of said other tube element, said tube element being mated side-by-side and upon and beneath with another like tube element by inverting one tube element end-to-end relative to an adjacent tube element such that the collar means on one tube element overlaps with the collar means on the other mating tube element, whereby said overlapping collar means form double overlapping collars, steel reinforcement means anchored in the corners of said collar means, said steel reinforcement means forming at the corners of said collar means closed loops to make said corners structurally stiff, and elongated steel concrete means located at the outer corners of said tube elements and adapted to interconnect the collars of mating like tube element.

3. A structural space element according to claim 2, further comprising reinforcement collar elements circumscribing said tube element at locations longitudinally spaced from the first said collar means.

4. A structural space element according to claim 3 whereby said reinforcement collar elements protrude from the outer wall of said tube element substantially the same amount as the first said collar means.

5. A structural space element according to claim 3 wherein said reinforcement collar element protrudes from the outer wall of said tube element less than the first said collar means.

6. A structural space element according to claim 2 wherein each of said collar means has an outer peripheral edge which protrudes from the outer wall of said tube element equally around the periphery of the tube element, the outer walls of mating tube elements being spaced from one another by an amount substantially equal to the amount that the said outer peripheral edge of said collar means protrudes from the outer wall of its respective tube element.

7. A structural space element according to claim 2 wherein said elongated steel concrete means protrude from the outer corners of said tube element and extend the length of said tube element.

8. A structural space element according to claim 7 wherein said collar means are provided with grooves in which said elongated steel concrete means are received.

9. A structural space element according to claim 2 wherein said collar means comprise outer circumscribing reinforcement steel elements circumbscribing the outer peripheral portion of said collar means and inner circumscribing reinforcement steel elements circumscribing the inner peripheral portion of said collar means.

10. A structural space element according to claim 9 wherein said outer and inner circumscribing reinforcement steel elements are made from the same steel and are anchored at the corners of said collar means by said closed loops.

* * * * *